US005458504A

United States Patent [19]

Lostumo et al.

[11] Patent Number: 5,458,504

[45] Date of Patent: Oct. 17, 1995

[54] QUICK RELEASE FOR CRT ANODE CONDUCTOR

[75] Inventors: Arthur J. Lostumo, Franklin Park; Steven J. Pulchinski, Rolling Meadows, both of Ill.

[73] Assignee: Zenith Electronics Corporation, Glenview, Ill.

[21] Appl. No.: 213,753

[22] Filed: Mar. 14, 1994

[51] Int. Cl.[6] ..... H01R 13/58

[52] U.S. Cl. ..... 439/460; 439/86

[58] Field of Search ..... 439/460, 275, 439/274, 86, 271, 461, 462

[56] References Cited

U.S. PATENT DOCUMENTS 4,387,947 6/1983 Lostumo et al. ..... 439/314

FOREIGN PATENT DOCUMENTS 9964 5/1895 Switzerland ..... 439/461

*Primary Examiner*—Gary F. Paumen

*Attorney, Agent, or Firm*—Roland W. Norris

[57] ABSTRACT

A quick release apparatus for a high voltage line connecting to a CRT sweep transformer has a plug with a split sleeve for grasping and retaining the high voltage lead when inserted into the transformer housing. The transformer housing contains an insulative sleeve as well as a conductive rubber pad for shorting the lead to the sweep transformer. The quick disconnect system is reliable and easily manufactured owing to its few parts.

8 Claims, 1 Drawing Sheet

QUICK RELEASE FOR CRT ANODE CONDUCTOR

BACKGROUND OF THE INVENTION

This invention is directed to improvements in high voltage disconnect plugs of the type used to couple a CRT sweep transformer voltage to the anode of the CRT.

In particular, it is desirable to be able to remove the high voltage anode wire from the sweep transformer so that servicing of a CRT display unit can be easily accomplished whether in the field or at a fully equipped maintenance facility. In general, it is desirable that the disconnect apparatus be simply manufactured and put together while maintaining electrical and structural integrity. Therefore, it is desirable that the disconnect system have few parts. Accordingly, it is an object of the present invention to provide an apparatus for quickly releasing a high voltage line from a CRT sweep transformer housing with the fewest possible parts.

BRIEF DESCRIPTION OF THE DRAWINGS

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

DESCRIPTION OF THE PREFERRED EMBODIMENT

Figure 4:
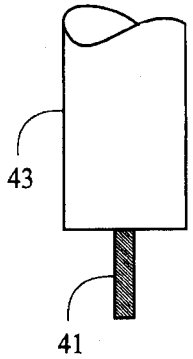
FIG. 4 is a side view of a typical high voltage lead which the present invention acts upon.
Figure 1:
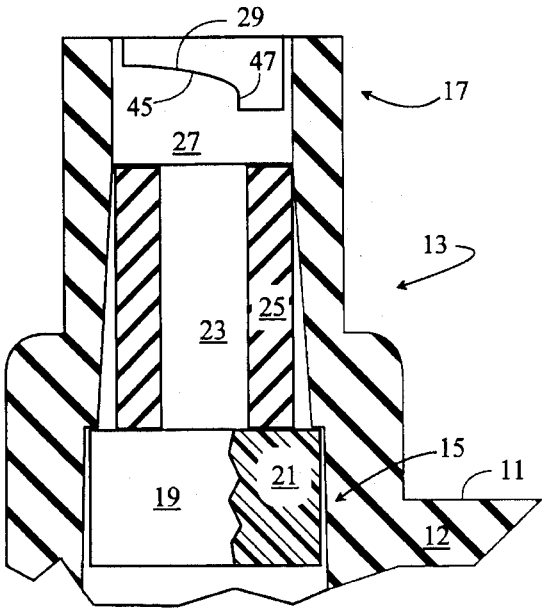
FIG. 1 is a sectional view of the sweep transformer housing exposing its barrel for receiving the high voltage line as a part of the apparatus according to the present invention.

As seen in FIG. 1, there is a transformer housing 11 having a barrel 13 for receiving an insulated wire high voltage conductor (FIG. 4). It will be understood by the artisan that the sweep transformer is located in the housing 11 at the area indicated by reference 12 and will ultimately be potted in a epoxy. The sweep transformer will have an electrical contact extending partially into the barrel 13 so as to make electrical contact with the high voltage lead inserted into the barrel.

In general the quick release apparatus of the present invention comprises the construction of the barrel 13 and the plug 31 (FIG. 2) together with a closely fitted insulative sleeve 25 and a conductive rubber pad 21. The barrel 13 has a first and second end, 15 and 17 respectively. At the first end 15 of the barrel 13 there is a first chamber 19 for receiving a conductive silicone rubber pad 21, shown in partial cross-hatch, into which the conductor 41 (FIG. 4) of the high voltage lead is inserted. A conductor from the sweep transformer (not shown) also contacts the conductive rubber pad 21 thereby shorting the high voltage lead to the transformer voltage as necessary for operation of the associated CRT.

The barrel has a second chamber 23 communicating with the first chamber 19 midway between first and second ends 15 and 17, respectively. The second chamber 23 closely receives a silicone rubber insulative sleeve 25 for surrounding the insulation 43 of the high voltage lead (FIG. 4) to prevent arcing. The bore of the insulative sleeve 25 is sized to closely receive the insulation 43 of the high voltage lead. The second chamber 23 preferably has a slightly bigger bore at its end proximal the first end of the barrel than the bore proximal the second end 17 of the barrel, thereby preventing the insulative sleeve from coming out through the second end 17 of the barrel when removal of the high voltage lead is desired.

Proximal the second end 17 of the barrel 13 is a third chamber 27. Located on the wall of the second chamber is a key rib 29 extending into the chamber. The rib extends downward from the barrel second end 17 towards the barrel first end 15 with a substantially diagonal rib portion 45 which ends in an abutment 47 extending substantially longitudinally along the barrel 13. Preferably there are two such ribs 29 placed on opposite sides of the third chamber 27. The ribs will contact the flanges 35 of the plug 31 (FIG. 2), as further explained below.

Figure 2:
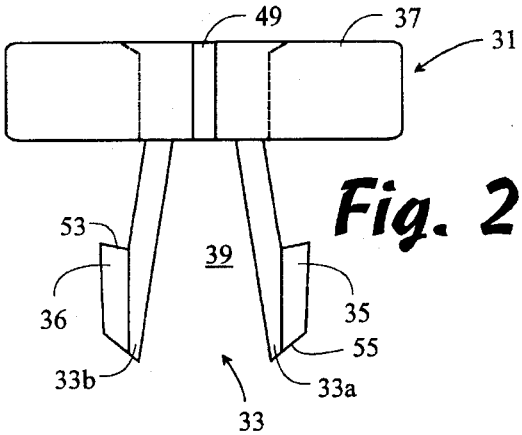
FIG. 2 is a side view of a split sleeve plug for surrounding a high voltage lead according to the present invention.
Figure 3:
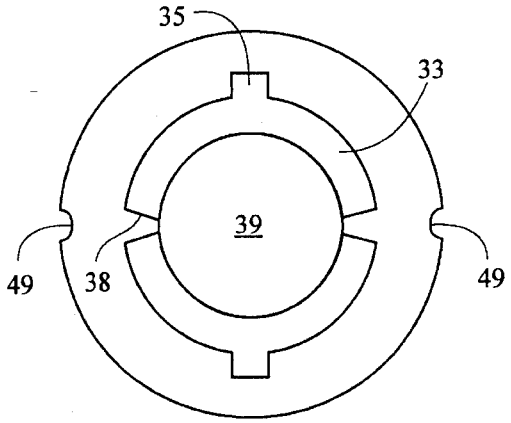
FIG. 3 is a bottom view of the split sleeve plug of FIG. 2.

As seen in FIGS. 2 and 3, the plug 31 is designed to surround and secure the high voltage lead insulation 43 (FIG. 4) and secure the high voltage lead within the transformer cup 11 as follows. The plug 31 is composed of a hard plastic and generally comprises a completely split sleeve 33 having identical halves **33*a*, 33*b*. A flange 35, 36 extends from each half of the split sleeve for engaging the key rib(s) 29 of the third chamber 27. As each half of the plug 31 and barrel 13** are identical in operation the singular will be used hereinafter where possible in this description.

The split sleeve 33 is preferably attached to a knob 37 for ease of handling. The knob 37 is preferably sized greater than the bore of the third chamber 27 to prevent over extension of the plug 31 within the barrel 13. As illustrated in FIG. 2, the knob 37 has an indentation 49 on either side thereof for accepting a keyed removal tool (not shown). This is designed to prevent unauthorized or accidental removal of the high voltage lead line by persons not having the tool. Alternatively, the knob could be knurled to aid in manual manipulation or replaced with armatures 51 as seen in FIG. 6.

The plug 31 has a central bore 39 extending through the knob 37 and split sleeve 33. The central bore 39 is of slightly smaller inside diameter than the outside diameter of the high voltage lead insulation 43 (FIG. 4) such that the split sleeve 33 is forced slightly apart upon insertion of the high voltage lead into the attitude as exaggeratedly illustrated in FIG. 2. As best seen in FIG. 3, the inside edge of the sleeve half at the split can have a sharp or toothed edge 38 to facilitate gripping of the split sleeve 33 onto the high voltage lead insulation 43.

In operation, the high voltage lead is placed through the plug 31 to the required depth such that the conductor 41 (FIG. 4) will extend into the conductive rubber pad 21 and insulation 43 will contact the insulative sleeve 25 in the second chamber 23. The flange top 53 then engages the diagonal portion 45 of the key rib 29 and the plug 31 is twisted by manipulation of the knob 37 such that the flange 35 rides down on the rib diagonal portion 45 until it reaches the abutment 47. This, in turn, forces the split sleeve lower end 55 into the insulative sleeve 25 causing the split sleeve 33 to contract about the insulation 43 and grip the high voltage lead. Thus, accidental removal of the high voltage lead by inadvertent pulling is prevented. Because the rib 29 and flange 35 engage without threading, a turn of less than 360 degrees on the knob 37 allows the plug 31 to be quickly secured to or released from the barrel 13.

Figure 5:
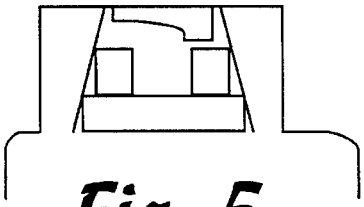
FIG. 5 is an alternative embodiment of the barrel of FIG. 1.
Figure 6:
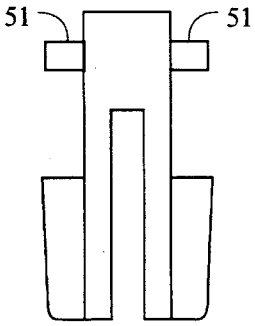
FIG. 6 is an alternative embodiment of the plug of FIG. 2.

As seen in FIGS. 5 and 6, alternative designs to the preferred embodiment as described in FIGS. 1–4 are available. While the present invention has been illustrated and described in connection with the preferred embodiments, it is not to be limited to the particular structure shown, because many variations thereof will be evident to one skilled in the art and are intended to be encompassed in the present invention as set forth in the following claims:

Having thus described the invention, what is claimed is:

1. An apparatus for quickly releasing a high voltage line from a CRT sweep transformer housing comprising:

A) a barrel on the sweep transformer housing having an opening for receiving the high voltage line, the barrel further having 1) a first chamber distal from the opening for receiving conductive material, a conductor of the high voltage line, and a conductor of the sweep transformer;

2) a second chamber medial in the barrel for receiving an insulative sleeve, 3) a third chamber proximal the opening for receiving a plug, the third chamber having a rib on the wall thereof, the rib extending substantially diagonally to the longitudinal axis of the barrel;

B) a plug, the plug having a split sleeve with a flange extending radially therefrom for non-threadably engaging the rib of the third chamber to secure the plug to the barrel, the split sleeve further having a center bore diameter for closely receiving the high voltage line.

2. The apparatus of claim 1 further comprising:

a knob attached to the split sleeve.

3. The apparatus of claim 1 further comprising a conductive rubber pad within the first chamber for receiving the conductor of the high voltage line.

4. The apparatus of claim 1 further comprising an insulative sleeve within the second chamber, the insulative sleeve having a central bore for closely receiving the high voltage line.

5. The apparatus of claim 1 wherein the second chamber is constructed and arranged to prevent removal of an insulative sleeve through the barrel opening.

6. An apparatus for quickly releasing a high voltage line from a CRT sweep transformer housing comprising:

A) a barrel on the sweep transformer housing having an opening for receiving the high voltage line, the barrel further having 1) a first chamber distal from the opening for receiving conductive material, a conductor of the high voltage line, and a conductor of the sweep transformer;

2) a second chamber medial in the barrel for receiving an insulative sleeve, 3) a third chamber proximal the opening for receiving a plug, the third chamber having a rib on the wall thereof, the rib extending substantially diagonally to the longitudinal axis of the barrel;

B) a plug, the plug having a split sleeve with a flange extending radially therefrom for engaging the rib of the third chamber, the split sleeve further having a center bore diameter for closely receiving the high voltage line, and C) a conductive rubber pad within the first chamber for receiving the conductor of the high voltage line.

7. The apparatus of claim 6 further comprising an insulative sleeve within the second chamber, the insulative sleeve having a central bore for closely receiving the high voltage line.

8. The apparatus of claim 6 wherein the second chamber is constructed and arranged to prevent removal of an insulative sleeve through the barrel opening.

* * * * *